US005249398A

United States Patent [19]

SpÅnberg

[11] Patent Number: 5,249,398

[45] Date of Patent: Oct. 5, 1993

[54] CESSPOOL

[75] Inventor: Bengt SpÅnberg, Sjöbo, Sweden

[73] Assignee: AB Sjobo Bruk, Sjöbo, Sweden

[21] Appl. No.: 792,000

[22] Filed: Nov. 14, 1991

[30] Foreign Application Priority Data

Nov. 19, 1990 [SE] Sweden ..... 9003668

[51] Int. Cl.[5] ..... E03F 7/04; E03F 11/00

[52] U.S. Cl. ..... 52/169.5; 52/1; 4/668; 4/681

[58] Field of Search ..... 52/169.5, 245, 247, 52/19, 20; 210/163, 542; 4/287, 695, 681, 668

[56] References Cited

U.S. PATENT DOCUMENTS 645,749 3/1900 Kasschau ..... 210/163
2,758,664 8/1956 Koenig .

FOREIGN PATENT DOCUMENTS 174954 4/1935 Switzerland .
394061 11/1965 Switzerland .
2134940 8/1984 United Kingdom .

*Primary Examiner*—Carl D. Friedman
*Assistant Examiner*—Matthew E. Leno

[57] ABSTRACT

A cesspool for handling waste water passed through the cesspool to an associated drainage system has two separate odor locks for preventing the escape of odoress gas from the drainage system through the cesspool. A downwardly extending inlet member is surrounded by and protrudes downwardly into a vertically movable cup. Water held by the cup normally provides a first odor lock between the cup and the inlet member. The cup is biased upwardly and has an upper edge which is engagable with an elastic seal to provide a second odor lock. The second odor lock assures an odor seal between the inlet member and the cup even when the water in the cup falls below the level required to maintain the first odor lock.

9 Claims, 4 Drawing Sheets

CESSPOOL

The present invention relates to a cesspool including an upwardly open cup and an inlet member directed downwards into said cup in such a way that water flowing through the inlet member can pass through the cup into a drainage system to which the cesspool is connected and whereby water standing in the cup forms an odor lock between the drainage system and inlet member.

In cesspools of this type, the odor lock functions as long as there is sufficient water in the cup. If no new water is fed to the cesspool for a long time, the water in the cup will however sink because of evaporation and when the water level has sunk below the lower edge of the inlet member, there is no longer sufficient water in the cup for providing an odor lock. When there is no longer an odor lock, evil smelling gases can flow up from the drainage system, which of course is not acceptable.

Another drawback in cesspools of the abovementioned type is that small animals, insects and bacteria can find their way up from the cesspool regardless of if there is water in the cup or not.

A further drawback is that the cesspool of the above type can not prevent waste water from the drainage system from forcing its way up from the cesspool when the drainage system is filled with water.

The object of the present invention is to eliminate the above drawbacks at a cesspool of the abovementioned type. This is arrived at substantially by means of the characterizing features of the following claim 1.

Since the cesspool has said characterizing features, it is ensured that the odor-lock function of the water in the cup is taken over by an odor lock defined when the cup engages the sealing when the water in said cup is sinking. The latter odor-lock function occurs long before the water in the cup has sunk to a level at which the water no longer defines an odor lock, which means that the cesspool always has an odor lock regardless of if there is water in the cup or not.

The invention will be further described below with reference to the accompanying drawings, wherein FIG. 1 is a vertical section of a cesspool according to the invention;

Figure 1:
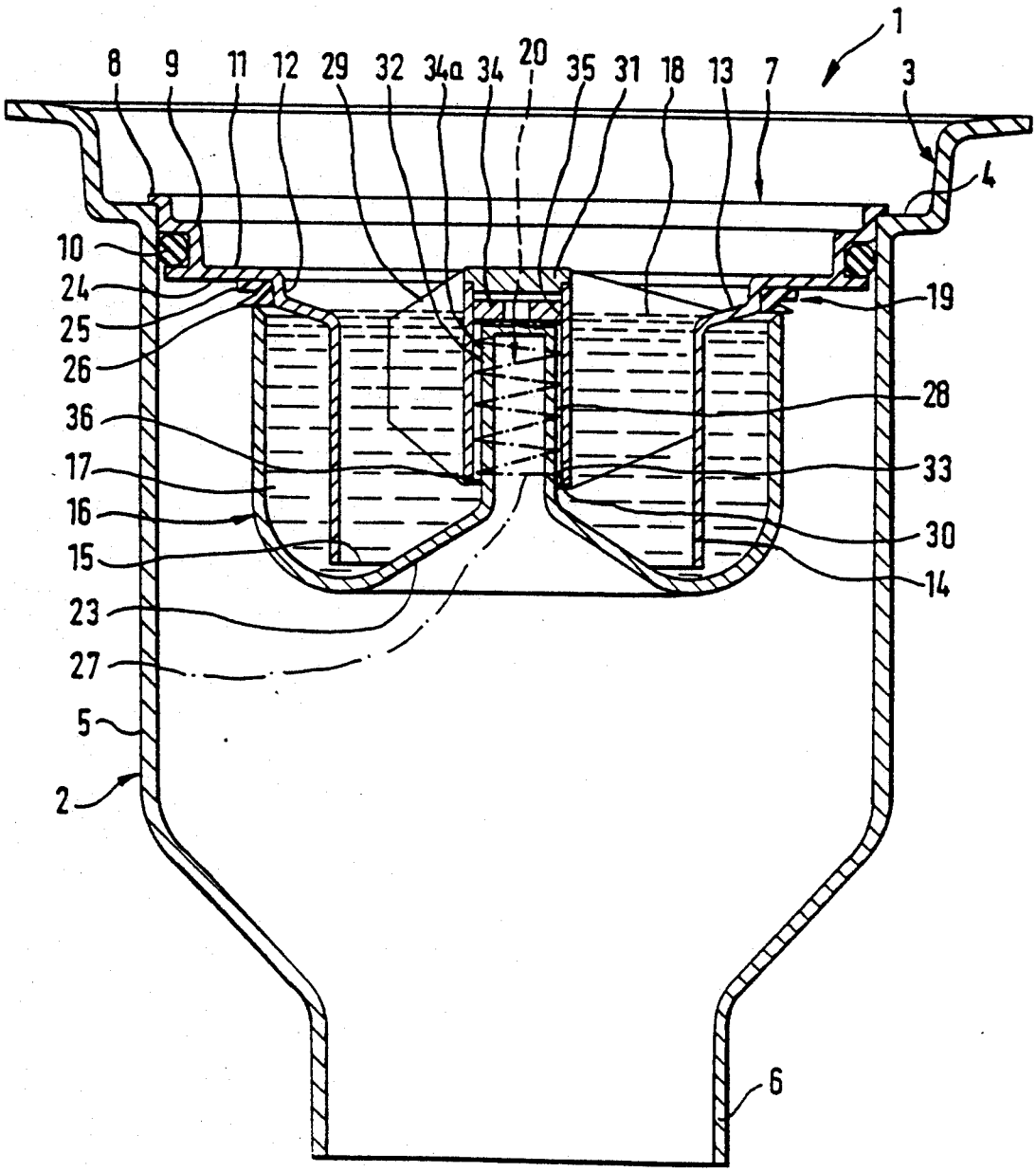
Figure 2:
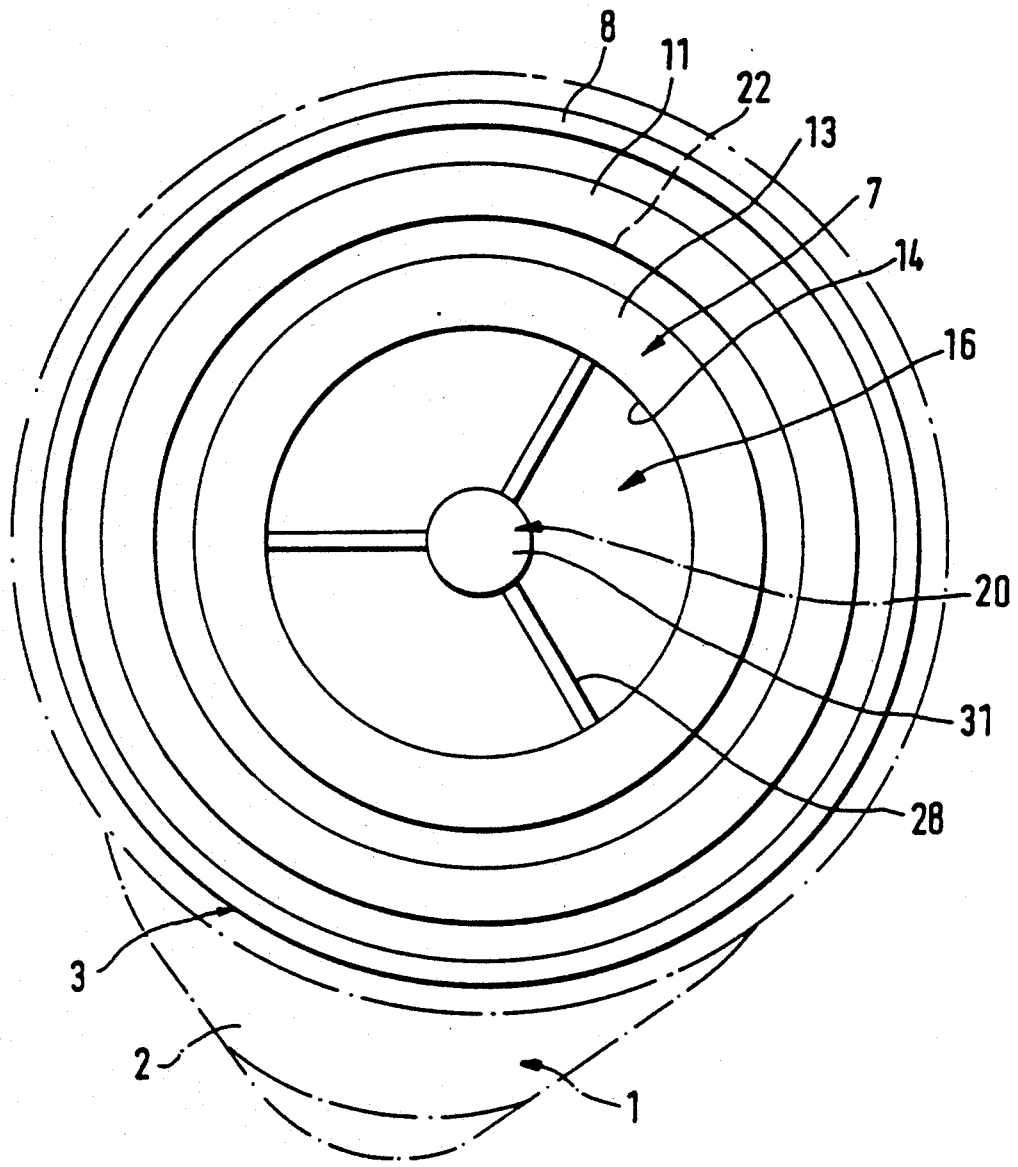
FIG. 2 is a top plan view of the cesspool of FIG. 1.

The figures illustrate a cesspool in the form of a bottom-discharging floor drain 1. This floor drain 1 includes an outer member 2 which at the top is provided with a seat portion 3, into which a floor mat is inserted. The floor mat is kept in place by means of a clamping ring which is also inserted into the seat portion 3. On top of the clamping ring there is provided a grating which is intended to form a cover to the interior of the floor drain and which is provided with openings or apertures for letting water into the floor drain. The design and disposition of the floor drain, clamping ring and grating are well known and therefore not further described here. Beneath the seat portion 3, the outer member 2 has an inwardly directed portion 4, the inner parts of which transform into a downwardly directed tube member 5. This tube member tapers down below and forms a tubular connecting portion 6, through which the floor drain 1 is connectable with a drainage system (not shown).

An inlet member 7 is provided in the outer member 2. This member 7 is on top provided with a preferably outwardly directed, circumferential flange portion 8, through which the inlet member 7 is suspendable at the inwardly directed portion 4 of the outer member 2. Beneath the flange portion 8, the inlet member 7 preferably has a circumferential groove 9 for a sealing ring 10 which is adapted to provide a tight connection between the outer member 2 and the inlet member 7.

The inlet member 7 further comprises a horizontally directed or substantially horizontally directed portion 11 which transforms into a downwardly directed portion 12. The latter portion 12 transforms into a downwardly/inwardly inclined portion 13 which in turn transforms into a downwardly directed tubular portion 14, the lower edge 15 of which defines the lower edge of the inlet member 7.

In order to provide an odor lock in the floor drain 1, said drain includes an upwardly open cup 16 into which the tube portion 14 of the inlet member 7 is inserted. Water 17 or another liquid in the cup 16 defines an odor lock as long as there is so much water in said cup 16 that the water surface 18 lies above the lower edge of the inlet member 7. Such an odor lock prevents gases from flowing up from the drainage system and into the surroundings through the floor drain 1.

Figure 4:
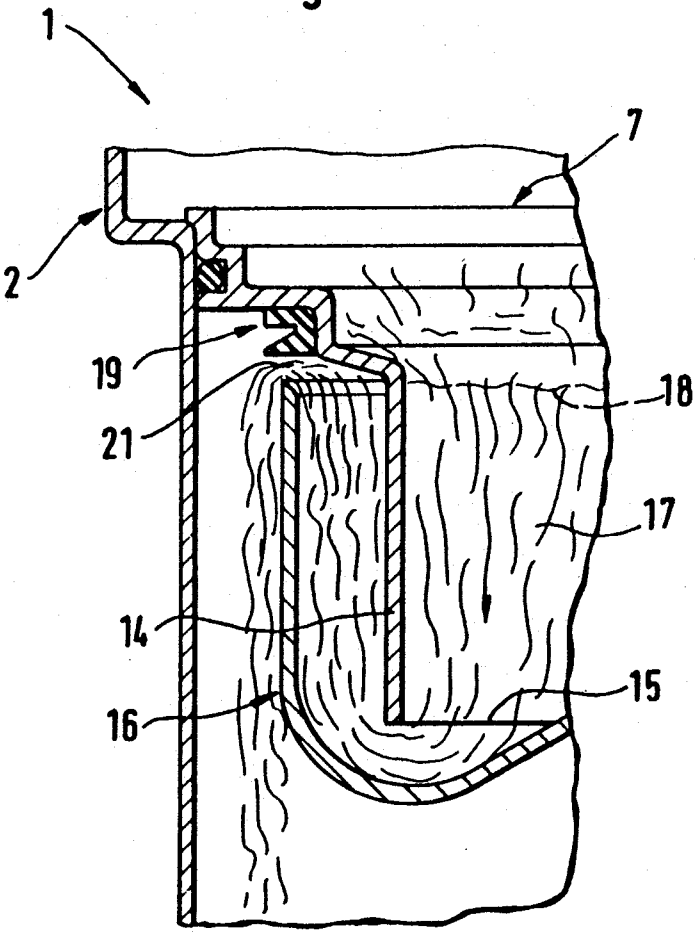
FIG. 4 is a section through the same part of the cesspool as in FIG. 3 but with the moveable member in another position.
Figure 3:
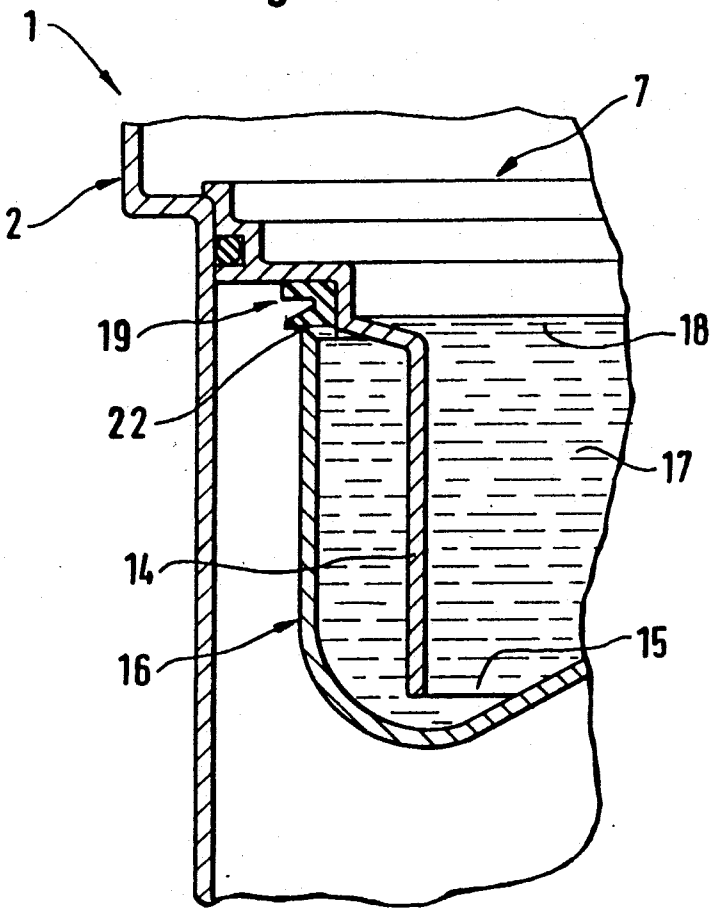
FIG. 3 is a section through a part of the cesspool of FIG. 1 with a movable member in an upper position.

In order to provide the floor drain 1 with, among other things, an odor-preventive function also if the level of water 17 in the cup, e.g. because of evaporation, falls such that the water surface lies beneath the lower edge 15 of the inlet member 7, the cup 16 is movably mounted relative to a seat 19 and it cooperates with at least one power generating means 20 which is provided to subject the cup 16 to such an upwardly directed force that said cup closely engages the seat 19 (see FIGS. 1 and 3). The power generating means 20 is also mounted such that it allows the cup 16 to move downwards from the seal 19 in order to define a throughflow gap 21 between said seat 19 and cup 16 through which water 17 can flow out of the cup 16 and into the drainage system (see FIG. 4).

When the power generating means 20 holds the cup 16 in close engagement with the seat 19, all connection between the drainage system and the surroundings through the floor drain 1 is closed whether there is sufficient water 17 in the cup 16 or not. If there is sufficient water 17 in the cup for defining an odor lock and said cup 16 closely engages the seat 19, said cup and seat prevent animals or bacteria from leaving the discharge system, and if there is not sufficient water in the cup for defining an odor lock, the cup and seat together define an odor lock. However, the power generating means 20 can yield if water flows down into the cup 16, such that the throughflow gap 21 is formed between the cup 16 and the seat 19, whereby water may pass out of the cup and into the drainage system. Hereby, it is ensured that the water does not rise out of the floor drain 1 when water flows thereinto, but instead, the floor drain "opens" and lets water through into the drainage system.

The power generating means 20 is preferably mounted such that it with a successively decreasing load thereon, from above presses the cup 16 against the seat 19 with a successively increasing pressure. This means that said means 20 presses the cup 16 harder and harder against the seat 19 while e.g. the water 17 evaporates from the cup and thus, the total weight of said cup decreases. Since the weight of the cup 16 is at its lowest when there is no water at all therein, said cup 16 engages the seat 19 with its highest pressure in such cases.

For keeping the floor drain 1 "closed" except when there is a certain amount of water therein and water also flows down through the inlet member 7, the power generating means 20 preferably is mounted such that it holds the cup 16 in close engagement with the seat 19 when the water surface 18 in the floor drain 1 is on level with the upper edge 22 of the cup 16 or slightly above or below this level, and such that the cup 16 moves downwards from the seat 19 when additional water is added to such amount of water through the inlet member 7.

The power venerating means 20 is preferably mounted and designed such that it subjects the cup 16 to such an upwardly directed force that said cup closely engages the seat when there is water therein up to a certain level and the weight of the cup 16 including the water 17 therein falls below a certain value. The power generating means 20 also allows for that when the upwardly directed force of said power generating means is overcome by the water 17 exceeding said level and thus, the weight of the cup 16 and the water therein as well as eventual water above said cup exceeds said value, the cup 16 is moved downwardly from the seat 19 to define the throughflow gap 21 between said seat 19 and cup 16. The power generating means 20 is also mounted to return the cup 16 to sealing engagement with the seat 19 if the water 17 again falls below said level and thus, the weight of the cup and the water therein falls below said value.

Preferably, the power generating means 20 is also mounted such that it allows the cup 16 to sink relative to the seat 19 in dependence of an increasing amount of water flowing into the cup 16 through the inlet member 7, whereby the width of the throughflow gap 21 increases momentarily in correspondence with the increase of the amount of water momentarily flowing into the cup 16 through the inlet member 7.

In those cases where the floor drain 1 is disposed at such a level, e.g. in the basement, that waste water from the drainage system can rise therein, the cup 16 is preferably mounted and/or designed such that waste water rising in the drainage system can move said cup towards the seat 19 and bring it to close engagement with said seat or, if the cup already engages the seat, increase its engagement pressure against the seat such that the waste water is prevented from flowing from the drainage system into the cup 16.

In order to make it possible for rising waste water to efficiently affect the cup 16 in upwards direction towards the seat 19 said cup preferably is provided with a bottom 23 which is cambering towards its central portions. By designing the bottom 23 of the cup 16 in this way, it is achieved that waste water rising quickly will have more difficulty in deflecting to the sides and instead affect the cup 16 with the highest possible force.

The seat 19 includes or consists of a ring 25 of elastic material, which is threaded on the downwardly directed portion 12 of the inlet member 7 and which engages a support surface 24 which is defined by the horizontally directed portion 11 of the inlet member 7. The ring 25 preferably has a circumferential tongue 26 and said tongue is preferably pointed and preferably more yielding than the remaining parts of the ring 25. The tongue 26 is adapted to form the sealing portion of the ring 25 engaged by the cup 16 and it can flex somewhat and/or adapt to the form of the upper edge 22 of the cup 16 when said cup engages it with pressure.

The power generating means 20 preferably consists of at least one helical spring 27, which is adapted to affect the cup 16 with a successively increasing force in an upwards direction towards the seat 19 the longer the cup 16, because of the pressure of water from above, starts to move downwards relative to the seat 19. The farther down from the seat 19 the cup is pressed the more the spring 27 is stretched, and the more the spring is stretched the more force does it apply to the cup 16 in upwards direction.

The helical spring 27 may consist of at least one compression or tension spring and it is preferably positioned centrally relative to the cup 16. In the embodiment of FIG. 1, the helical spring 27 consists of a compression spring which is disposed centrally relative to the cup 16. In order to mount this compression spring in a suitable manner, the inlet member 7 includes a sleeve 28 which is positioned centrally in its tubular portion 14 and which is provided on a plurality of, preferably three brackets 29 extending radially in the inlet member 7. These brackets are preferably designed as guide flanges for opposing turbulent flow of water when water pass through the inlet member 7.

Down below the sleeve 28 has a bottom 30 with a hole and on top an opening which can be closed by a lid 31 which can be snapped-in over the sleeve in a suitable manner. The interior of the sleeve 28 may also define a stop surface (not shown) provided somewhat closer to the bottom 30 thereof than to the lid 31. The cup 16 preferably comprises an upwardly directed tap 32, which protrudes from the bottom 23 of the cup and extends upwardly in the centre of said cup. The tap 32 may e.g. consist of a sleeve like, upwardly directed and on top closed portion of the bottom 23 of the cup 16 as is shown in FIG. 1. The tap 32 is sized such that it from below can be inserted into the sleeve 28 through the hole in the bottom 30 thereof and it is so much thinner than the sleeve 28 that a space is defined between the tap and the sleeve, wherein the helical spring 27 is positioned.

For applying the helical spring 27 in operating position, the tap 32 is inserted into the sleeve 28 from below. Thereafter, the helical spring 27 is threaded onto the tap 32 from above until said spring down below engages a support surface 33 which is defined preferably by the upper side of the bottom 30 of the sleeve 28. Thereafter, the spring 27 is stretched until an end portion 34 from above can be snapped-in over the upper end portion of the tap 32. This end portion 34 engages the inner side of the sleeve 28 with its outer edge such that said outer edge defines guide surfaces 35 for the upper parts of the tap 32. The lower side of the end portion 34 forms a support surface 34*a* engaged by upper parts of the helical spring 27, and guide surfaces 36 for lower parts of the tap 32 are formed preferably by the inner edge of the bottom 30. When the helical spring 27 is mounted in operating position, the sleeve 28 is closed from above by means of the lid 31.

The helical spring 27 is preferably sized beforehand such that it in operating position in the sleeve 28 presses the cup 16 upwards towards the seat 19 with such a force that said cup 16 engages said seat 19 when said cup is filled with water 17, substantially filled with water or the water level lies somewhat above the upper edge 22 of the cup 16, but not above the upper edge of the floor drain 1. Preferably, the helical spring 27 also permits displacement of the cup 16 downwards from the seat 19 if it is thereby filled with more water, whereby the water level does not rise, but instead water can flow out into the drainage system.

The abovementioned stop surface formed by the sleeve 28 permits limited downward movement of the cup 16 relative to the sleeve 28, so that the helical spring 27 can not be compressed to an unfavourable extent. This limitation of the movement of the cup 16 is achieved while the end portion 34 hits said stop surface when the cup 16 has moved downwards a distance which preferably is somewhat longer than half the height of the sleeve 28.

Since the cup 16 is guided as described or in another way when displaced relative to the seat 19, it is ensured that the cup 16 is moved parallel to the tubular portion 14 of the inlet member 7 and that the upper edge 22 of the cup 16 can engage the seat 19 around the entire cup. Since the cup 16 is centered with the tubular portion 14 and defines an annular throughflow gap 21 of unitary width above the upper edge 22 of the cup 16, the floor drain attains a favourable throughflow capacity when it is open.

Figure 5:
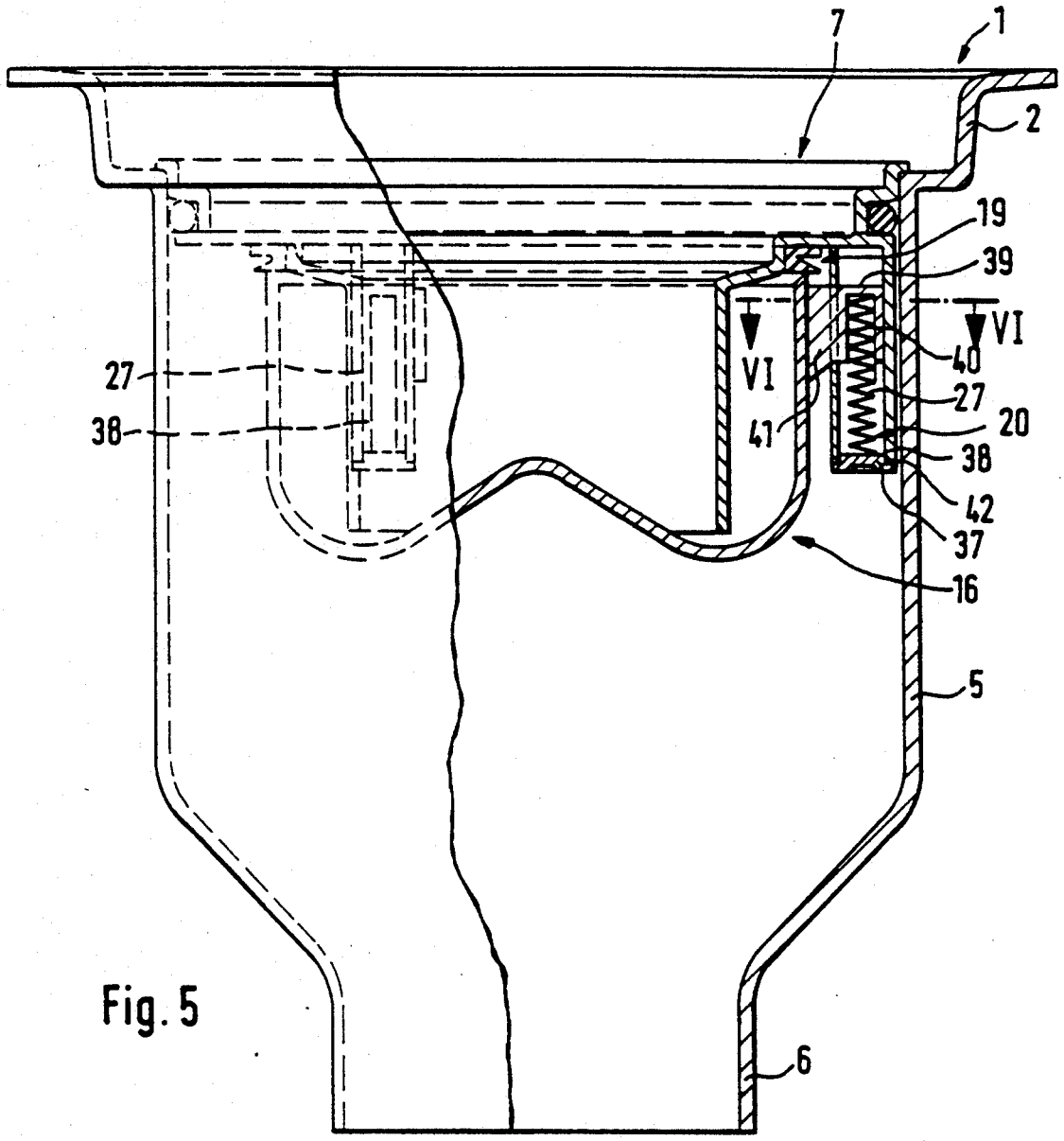
FIG. 5 is a side view, partly in section, of a second embodiment of the cesspool according to the invention.
Figure 6:
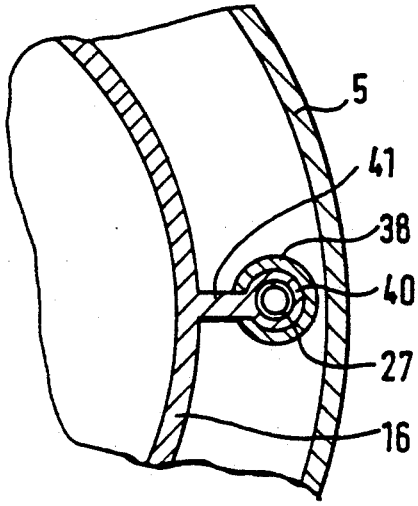
FIG. 6 is a section through the cesspool of FIG. 5 along the line VI—VI.

In FIG. 5 there is illustrated another embodiment of the floor drain 1, wherein three helical springs 27 provided in the floor drain on the outside of the cup 16 are utilized for holding said cup in close engagement with the seat 19 and for allowing downward movement of said cup. Each helical spring 27 is preferably a compression spring which down below engages a support surface defined by a bottom portion 37 of a sleeve 38 which at the top is fastened to the horizontally directed portion 11 of the inlet member 7. At the top, the helical spring 27 preferably engages a support surface which is defined by an upper end surface 39 on a sleeve 40 which is positioned in the sleeve 38 and connected to the cup 16 through a flange 41. The sleeve 40 is guided by the sleeve 38 and the helical spring 27 can be threaded onto a tap 42 on the bottom portion 37, whereafter the helical spring 27 is inserted into the sleeve 38 and the sleeve 40 until said bottom portion 37 can be snapped-in over the sleeve 38 down below.

The three helical springs 27 together permit close engagement of the cup 16 against the seat 19 and they also permit downward displacement of said cup against their resetting forces at increasing load from above.

The cup 16 is preferably designed such that a gap is provided between the bottom 23 of the cup 16 and the lower edge 15 of the tubular portion 14 also when the cup 16 engages the seat 19. Hereby, it is ensured that through said gap, parts of the cup 16 within the tubular portion 14 are always connected to parts of the cup 16 outside the tubular portion 14, i.e. also when said cup 16 engages said seat 19.

The cup 16 is preferably designed such that the width of the gap is small in relation to the total height of the cup 16 when said cup engages the seat 19.

As is apparent from e.g. FIG. 1, the downwardly directed portion 14 of the inlet member 7 projects downward from a level at which the seat is disposed. The cup 16 has upwardly directed walls extending upwards from the bottom 23 of said cup along the downwardly directed portion 14 of the inlet member 7 and the cup 16 can be moved into engagement with the seat 19 through the upper edge 22 of the upwardly directed walls.

The upwardly directed walls of the cup 16 are preferably situated at a substantial distance from the downwardly directed portion 14 of the inlet member 7 for providing a wide, upwardly directed throughflow gap between said downwardly directed portion 14 and the upwardly directed walls of the cup 16. Furthermore, the downwardly directed portion 14 of the inlet member 7 is tubular and vertically directed or substantially vertically directed. The walls of the cup 16 are also vertically directed or substantially vertically directed and substantially as high as said downwardly directed portion 14.

The invention is not limited to the embodiments described above and illustrated in the drawings, but may very within the scope of the following claims. As examples of alternative applications and not illustrated or only schematically illustrated detail modifications, it should be mentioned that the cesspool must not be a floor drain (it can be e.g. a roof drain); the cesspool must not be bottom-discharging (it can be e.g. side-discharging); the inlet member 7 can be of another type than shown and it is preferably removably mounted in the cesspool, but can be fixed therein; the seat 19 may be of another type than shown and disposed in another way; the power generating means may be of another type than helical springs (e.g. a tension spring or other means than a spring) and it or they can be mounted in other ways than shown (e.g. between a yoke beneath the cup 16 and the underside thereof); the cup 16 can have another shape than illustrated and preferably have a pointed upper edge 22 for preventing contaminants from adhering thereto and the force of the power generating means 20 may, when required, in certain cases be selected such that the cup 16 can be displaced downwards when water is flowing thereinto when it is already e.g. half full.

I claim:

1. Cesspool, including an upwardly open cup (16) and an inlet member (7) protruding thereinto from above in such a way that water (17) flowing through said inlet member (7) and through said cup (16) can pass into a drainage system to which the cesspool (1) is connected and whereby water (17) in said cup (16) forms a first odor lock between the drainage system and the inlet member (7), said cup (16) being movably mounted relative to a seat (19) and cooperating with at least one power generating means (20) for bringing said cup (16) into close odor sealing engagement with said seat (19) such that said cup (16) and seat (19) with each other define a second odor lock if the force applied by said water (17) to said cup (16) falls below a given value, said power generating means (20) being mounted such that it with a successively decreasing load thereon, resulting from a successively decreasing force applied by said water (17) to said cup (16), presses said cup (16) against said seat (19) with a successively increasing pressure, means mounting said cup (16) for movement relative to said seat (19) so that waste water rising in said drainage system can move said cup (16) towards said seat (19) and bring it to close engagement with said seat (19) or, if said cup (16) already engages said seat (19), can increase its engagement pressure against the seat (19) to prevent the waste water from flowing from the drainage system into said cup (16), said cup (16) having a cambered bottom (23) against which waste water rising from below said cup may press to urge said cup upwardly toward said seat (19).

2. Cesspool, including an upwardly open cup (16) and an inlet member (7) protruding thereinto from above in such a way that water (17) flowing through said inlet member (7) and through said cup (16) can pass into a drainage system to which the cesspool (1) is connected and whereby water (17) in said cup (16) forms a first odor lock between the drainage system and the inlet member (7), said cup (16) being movably mounted relative to a seat (19) and cooperating with at least one power generating means (20) for bringing said cup (16) into close odor sealing engagement with said seat (19) such that said cup (16) and seat (19) with each other define a second odor lock if the force applied by said water (17) to said cup (16) falls below a given value, said power generating means (20) being mounted such that it with a successively decreasing load thereon, resulting from a successively decreasing force applied by said water (17) to said cup (16), presses said cup (16) against said seat (19) with a successively increasing pressure, said seat (19) including a ring (25) of elastic material mounted on a portion (12) of said inlet member (7) and engaging downwardly facing support surface (24) on said inlet member (7), said ring (25) having a circumferential tongue (26) which is more yielding than other parts of the ring (25) and which forms a sealing portion for engagement by the cup (16).

3. Cesspool, including an upwardly open cup (16) and an inlet member (7) protruding thereinto from above in such a way that water (17) flowing through said inlet member (7) and through said cup (16) can pass into a drainage system to which the cesspool (1) is connected and whereby water (17) in said cup (16) forms a first odor lock between the drainage system and the inlet member (7), said cup (16) being movably mounted relative to a seat (19) and cooperating with at least one power generating means (20) for bringing said cup (16) into close odor sealing engagement with said seat (19) such that said cup (16) and seat (19) with each other define a second odor lock if the force applied by said water (17) to said cup (16) falls below a given value, said power generating means (20) being mounted such that it with a successively decreasing load thereon, resulting from a successively decreasing force applied by said water (17) to said cup (16), presses said cup (16) against said seat (19) with a successively increasing pressure, said inlet member (7) having a tubular portion (14) extending downwardly into said cup (16) and said tubular portion having a lower edge (15), said cup (16) being designed such that a gap is provided between the bottom (23) of said cup (16) and said lower edge (15) when said cup (16) engages said seat (19), said gap providing constant communication between the space inside of said tubular portion (14) and the space surrounding said tubular portion (14) when said cup (16) engages said seat (19).

4. Cesspool according to claim 3 wherein said cup (16) is supported for movement upwardly and downwardly relative to said seat (19) with said seat (19) being oriented so that upward movement of said cup relative to said seat moves said cup toward engagement with said seat and downward movement of said cup relative to said seat moves said cup away from said seat, and said power generating means (20) consists of one helical spring (27) positioned centrally relative to said cup and adapted to affect said cup with a successively increasing force in an upwards direction towards said seat (19) the farther said cup (16) is moved downwardly away from said seat (19), said helical spring being located in a sleeve (28) mounted centrally in said inlet member (7) and being threaded onto a tap (32) directed upwards in said cup and protruding into said sleeve (28) from below, said spring having a bottom end which engages a support surface (33) on said sleeve (28) and also having an upper end which engages a support surface (34*a*) fixed relative to said tap (32) with said spring being compressed between said support surfaces (33 and 34*a*), said sleeve (28) having a stop surface which is adapted to limit the downward movement of said cup (16) relative to the sleeve (28).

5. Cesspool according to claim 3 wherein said cup (16) is supported for movement upwardly and downwardly relative to said seat (19) with said seat (19) being oriented so that upward movement of said cup relative to said seat moves said cup toward engagement with said seat and downward movement of said cup relative to said seat moves said cup away from said seat, and said power generating means (20) consists of a plurality of helical springs adapted to affect the cup (16) with a successively increasing force in an upwards direction towards said seat (19) the farther said cup (16) is moved downwardly away from said seat (19), said helical spring being mounted in the cesspool (1) on the outside of said cup (16), each of said helical springs having a bottom end which engages a support surface (37) fixed relative to the seat (19) and an upper end which engages a support surface (39) fixed relative to the cup (16) with the spring being compressed between said support surfaces (37 and 39).

6. Cesspool according to claim 5 wherein said support surface engaged by the upper end of each spring is an end wall (39) of a sleeve (40) connected to the cup (16), and said support surface engaged by the bottom end of each spring is located on the bottom portion (37) of a sleeve (38) connected to a member (7) fixed relative to the seat (19), said sleeve (40) connected to said cup (16) being movably mounted inside said sleeve (38) fixed relative to said seat and being guided thereby during its movement.

7. Cesspool according to claim 3 wherein said cup (16) is so constructed and arranged that the width of said gap is smaller than the total height of said cup (16) when said cup engages said seat (19).

8. Cesspool according to claim 3 wherein said cup (66) has a side wall surrounding said tubular portion (14) of said inlet member (7) which side wall is spaced a substantial distance from said tubular portion (14) of said inlet member (7) so as to provide a wide vertically extending annular throughflow gap between said tubular portion (14) and said side wall of said cup (16).

9. Cesspool according to claim 3 wherein said cup (16) has a vertically extending side wall surrounding and spaced from said tubular portion and having a height substantially equal to that of said tubular portion.

* * * * *